United States Patent [19]

Segersten

[11] 4,090,510

[45] May 23, 1978

[54] FACE MASK WITH EXCHANGEABLE FILTER

[75] Inventor: Goran Segersten, Orebro, Sweden

[73] Assignee: Rebo-Produkter, Orebro, Sweden

[21] Appl. No.: 760,385

[22] Filed: Jan. 19, 1977

[30] Foreign Application Priority Data

Feb. 5, 1976 Sweden ..... 7601232

[51] Int. Cl.[2] ..... A62B 7/10

[52] U.S. Cl. ..... 128/146.6

[58] Field of Search ..... 128/146.6, 139, 140 R, 128/141 R, 142 R, 146 R, 146.2, 146.3, 146.4, 146.6, 146.7, 205, 195

[56] References Cited

U.S. PATENT DOCUMENTS

| | | | |
|---|---|---|---|
| 1,579,449 | 4/1926 | Hubbell | 128/146.6 |
| 2,067,026 | 1/1937 | Schwartz | 128/146.6 |
| 2,296,150 | 9/1942 | Dockson et al. | 128/146.6 |
| 2,681,060 | 6/1954 | Swindell | 128/146.6 |

FOREIGN PATENT DOCUMENTS

| | | | |
|---|---|---|---|
| 680,339 | 10/1952 | United Kingdom | 128/146.6 |

*Primary Examiner*—Robert W. Michell
*Assistant Examiner*—Henry J. Recla
*Attorney, Agent, or Firm*—Hane, Roberts, Spiecens & Cohen

[57] ABSTRACT

A facemask for covering the nose and mouth of a user including a perforated cover member made of leather, plastics, or another suitable material and having fastening devices opposingly secured at opposing peripheral edges thereof, an outside filter layer for intercepting coarse particles, an inside filter layer for intercepting fine particles and secured to the outside filter layer at an intermediate location thereof, each fastening device clamping the outside filter layer to the inside surface of the cover member, the inside filter layer also serving to protect the face of the wearer against the fastening device and a band secured to opposing peripheral edges of tee cover member for securing the mask to the face of the user.

1 Claim, 4 Drawing Figures

FACE MASK WITH EXCHANGEABLE FILTER

BACKGROUND OF THE INVENTION

The present invention refers to a face mask with filter for interception of particles. There are a large number of such masks on the market. A well-known mask consists of rubber and it has a circular, front opening where a circular filter made of paper or a similar material can be placed, which will prevent various kinds of particles from being breathed in by a person who uses the mask. An exchange of filter in such a device is not connected with large inconvenience, but after all there are detachable parts which may be lost, and such a face mask is also relatively expensive to produce.

SUMMARY OF THE INVENTION

The purpose of the present invention is to create a simple and inexpensive face mask which consists of a cover made of leather, plastics or any suitable material. The cover can suitably be punched out of a leather material and then later be joined into a mask. The entire surface of the cover is fitted with holes so that the air intake is not restricted to a limited area of the face mask. The cover is equipped with a filter on the inside, which will more or less cover the whole of the inside of the cover. The filter can also be punched out of a plane layer, and the punched part can by and large have the same shape as the cover when that was punched. The filter can be joined in almost the same way as the cover and is then placed inside the cover. The filter consists of two layers, an outside layer and an inside layer. Both layers can suitably be made of some kind of cellulose material. The outside layer is intended to filter the coarse particles and the inside layer the fine particles.

In its periphery the cover is fitted with a number of metal clips, which are to fasten the filter to the cover. The fastening part of the clips is arranged between the two layers when serving the fastening function.

Further characteristics of the present invention will appear from the following patent claims.

The present invention will be described in detail in connection with the enclosed three drawings, where FIG. 1 shows a face mask according to the present invention, where a filter is being fastened, where FIG. 2 shows a face mask seen from the front, where FIG. 3 shows a filter and a face mask separated from each other, and where FIG. 4 shows a person using the face mask.

DESCRIPTION OF THE PREFERRED EMBODIMENT

Figure 1:
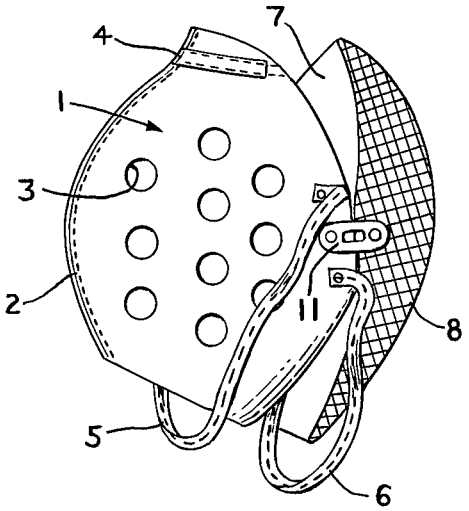

In the figures, number 1 is one half of the punched out object made of leather. In connection with the punching 2 halves are obtained with a common interconnecting line. The two halves are bent against each other around the interconnecting line, and a seam 2 is made along the joining edges. The two halves of the cover are fitted with a number of holes 3, which means that the whole of the face mask will more or less allow air to enter through the mask. At the top end of the cover is a metal band 4, which is bent at a rib formed by the seam 2. The metal band is fastened by means of a sewn on ribbon. By means of the metal band the face mask can be given a permanent shape close to the nose of the user. The face mask is connected with two ribbons 5 and 6, which are principally elastic and which are intended to keep the mask firmly against the user's head 12.

Figure 3:
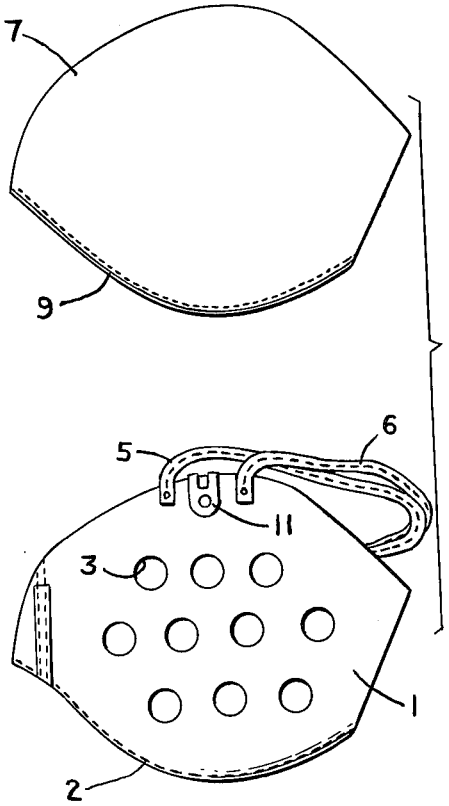
Figure 2:
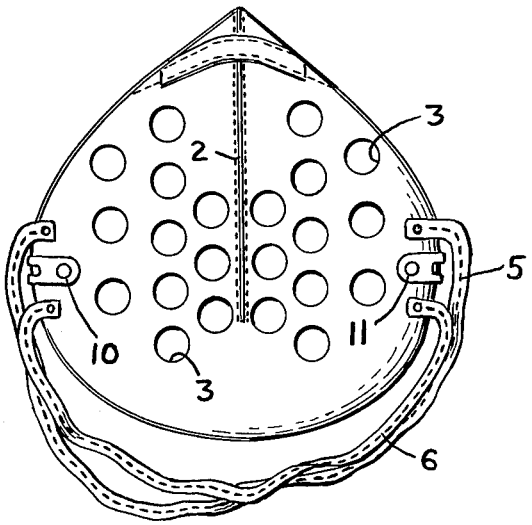
Figure 4:
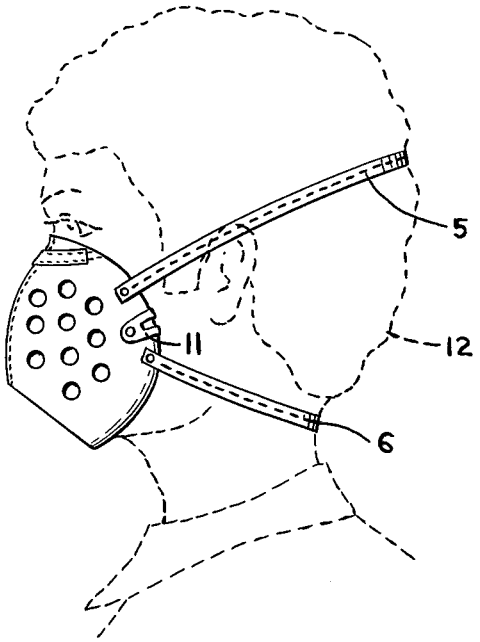

In FIG. 3 is shown an outside sheet of filter 7. This sheet of filter consists of two halves, which are bent around the right edge and then joined with each other by means of a seam 9. The sheet of filter 7 is made of a suitable cellulose material and the purpose of this is to intercept coarse particles. A similar sheet 8 has been punched and the purpose of this is to intercept fine particles. Before the sheet of filter 7 is folded the seet 8 shall be placed on top of it. Then the sheet of filter 7 is folded as shown in FIG. 3, and the seam 9 is made. In this way the filter is going to have an outside part 7 and an inside part 8. The cover 1 is equipped with two stiff metal bands 10 and 11, which are fastened to the cover and which can both be bent round the edge of the cover.

Before the bending, a filter is placed in the cover as shown in FIG. 1. When the filter has been placed in the cover the inside filter is bent away and then the bands 10 and 11 are pinched against the inside wall of the cover, and in between is the outside filter 7. Then the filter 8 is bent so that it lies true against the filter 7. By applying this procedure the user 12 will protect his face against contact with the clips 10 and 11.

The advantage of the present invention is that a face mask is obtained which will allow the intake of air throughout almost the whole of its surface and which has a filter that corresponds to the inside surface of the mask. In this way an obviously simple mask is obtained and further, the mask is very easy to fasten because it consists of two layers.

I claim:

1. A facemask with a filter for intercepting particles of various sizes, comprising a perforated cup-shaped cover member for covering the nose and mouth of a user, an outside filter layer made of filter material for filtering coarse particles and shaped to fit within the inside surface of said cover member, an inside filter layer made of material for filtering fine particles and shaped to fit within said outside filter layer, said inside and outside filter layers being secured to each other at an intermediate location thereof, said cover member, said outside filter layer, and said inside filter layer having approximatery the same surface area, means for securing said facemask to the face of a user, said cover member including fastening means secured at opposing peripheral edges thereof, said fastening means clamping said outside filter layer against the inside surface of said cover member whereby, said inside filter layer covers said fastening means and protects the face of the user against contact thereof.

* * * * *